US008164054B2

(12) United States Patent
Nishiguchi et al.

(10) Patent No.: US 8,164,054 B2
(45) Date of Patent: Apr. 24, 2012

(54) MASS ANALYSIS METHOD AND MASS ANALYSIS SYSTEM

(75) Inventors: Masaru Nishiguchi, Hirakata (JP); Shigeki Kajihara, Uji (JP)

(73) Assignee: Shimadzu Corporation, Kyoto (JP)

( * ) Notice: Subject to any disclaimer, the term of this patent is extended or adjusted under 35 U.S.C. 154(b) by 99 days.

(21) Appl. No.: 12/747,728

(22) PCT Filed: Dec. 13, 2007

(86) PCT No.: PCT/JP2007/001390

§ 371 (c)(1),
(2), (4) Date: Jul. 14, 2010

(87) PCT Pub. No.: WO2009/075011

PCT Pub. Date: Jun. 18, 2009

(65) Prior Publication Data

US 2010/0282965 A1 Nov. 11, 2010

(51) Int. Cl.
*H01J 49/40* (2006.01)

(52) U.S. Cl. ..... 250/287

(58) Field of Classification Search ..... 250/287, 250/281, 282

See application file for complete search history.

(56) References Cited

U.S. PATENT DOCUMENTS

2010/0258716 A1* 10/2010 Yamaguchi ..... 250/287
2011/0192971 A1* 8/2011 Yamaguchi ..... 250/282

FOREIGN PATENT DOCUMENTS

JP 11-135060 A 5/1999
JP 11-135061 A 5/1999
JP 11-195398 A 7/1999
JP 2005-079049 A 3/2005

OTHER PUBLICATIONS

Michisato Toyoda et al., "Multi-turn time-of-flight mass spectrometers with electrostatic sectors", Journal of Mass Spectrometry, Nov. 3, 2003, pp. 1125-1142, vol. 38.

* cited by examiner

*Primary Examiner* — Kiet T Nguyen
(74) *Attorney, Agent, or Firm* — Sughrue Mion, PLLC

(57) ABSTRACT

A measurement is performed in a no-passing mode, in which ions having different masses are prevented from making a complete turn through a loop orbit, to obtain a time-of-flight spectrum without the passing of ions having different masses (S1 and S2). From the time of flight and other information of the peaks appearing on the time-of-flight spectrum (S3), the number of turns and the time of flight in the loop-turn mode are predicted. Based on this prediction, a set of segments are defined on a time-of-flight spectrum in the loop-turn mode. The time widths of those segments are determined taking into account the spreads of the time widths of the aforementioned peaks. Since the number of turns is unique within each segment, the numbers of turns and the masses of the peaks can be uniquely determined as long as none of the segments overlap each other. Accordingly, it is determined whether there is any overlapped portion in the segments defined on the time-of-flight spectrum in the loop-turn mode under provisionally predetermined conditions. When a condition under which no overlapping occurs has been found, the segment setting is fixed (S4-S6). As a result, the timing for switching an ejection switch, which is used for ejecting ions from the loop orbit, is also determined. Based on this timing, a measurement in the loop-turn mode is performed (S7).

14 Claims, 5 Drawing Sheets

Fig. 6

| | seg. | range (ns) | linear TOF (ns) | lap | mass (u) |
|---|---|---|---|---|---|
| | 1 | 667734 - 668176 | 9493 - 9500 | 104 | 77.29 - 77.40 |
| | 2 | 673168 - 673712 | 9756 - 9763 | 102 | 81.63 - 81.75 |
| | 3 | 672160 - 672440 | 14936 - 14943 | 66 | 191.33 - 191.51 |
| | 4 | 670098 - 670428 | 15829 - 15836 | 62 | 214.89 - 215.08 |
| | 5 | 678921 - 679245 | 16294 - 16301 | 61 | 227.70 - 227.90 |
| | 6 | 670367 - 670609 | 17188 - 17195 | 57 | 253.37 - 253.58 |
| | 7 | 680556 - 680806 | 21048 - 21055 | 47 | 379.95 - 380.21 |
| MULTIPLE PEAKS INCLUDED → | 8 | 679415 - 679677 | 23979 - 23988 | 41 | 493.14 - 493.51 |
| | 9 | 674690 - 674892 | 25621 - 25628 | 38 | 562.99 - 563.30 |
| | 10 | 681774 - 681976 | 25890 - 25897 | 38 | 574.87 - 575.19 |
| | 11 | 690021 - 690177 | 26883 - 26890 | 37 | 619.82 - 620.14 |
| | 12 | 684184 - 684370 | 28117 - 28124 | 35 | 678.03 - 678.36 |
| | 13 | 682156 - 682296 | 29658 - 29665 | 33 | 754.38 - 754.74 |
| | 14 | 683283 - 683423 | 29707 - 29714 | 33 | 756.88 - 757.24 |
| | 15 | 685514 - 685654 | 29804 - 29811 | 33 | 761.83 - 762.19 |

Fig. 7

| | CALCULATED VALUES | ORIGINAL DATA |
|---|---|---|
| | mass (u) | mass (u) |
| 1 | 77.362 | 77.362 |
| 2 | 81.699 | 81.699 |
| 3 | 191.438 | 191.438 |
| 4 | 215.001 | 215.001 |
| 5 | 227.815 | 227.815 |
| 6 | 253.502 | 253.502 |
| 7 | 380.087 | 380.087 |
| 8 | 493.258 | 493.258 |
| 9 | 493.307 | 493.307 |
| 10 | 493.357 | 493.357 |
| 11 | 493.406 | 493.406 |
| 12 | 493.455 | 493.455 |
| 13 | 563.158 | 563.158 |
| 14 | 575.055 | 575.055 |
| 15 | 620.011 | 620.010 |
| 16 | 678.225 | 678.225 |
| 17 | 754.598 | 754.597 |
| 18 | 757.097 | 757.097 |
| 19 | 762.059 | 762.059 |

MASS ANALYSIS METHOD AND MASS ANALYSIS SYSTEM

TECHNICAL FIELD

The present invention relates to a mass analysis method and mass analysis system, and more specifically to a method and system for a multi-turn time-of-flight mass analysis using an ion optical system that makes ions fly along a closed orbit.

BACKGROUND ART

Time-of-flight mass analyzers is a type of device that performs mass analyses by measuring the time of flight required for each ion to travel a specific distance and converting the time of flight to a mass. This analysis is based on the principle that ions accelerated by a specific amount of energy will fly at different speeds that correspond to their mass. Therefore, to improve the mass resolution, it is effective to provide the longest possible flight distance. For this purpose, multi-turn time-of-flight mass spectrometers have been developed and have successfully achieved high levels of mass resolution (for example, refer to Patent Documents 1 to 3 and Non-Patent Document 1). This type of mass spectrometer has a closed orbit of various forms (such as a substantially circular shape, substantially elliptical shape, "figure-8" shape or any other shapes), through which the ions are made to fly multiple times so as to increase their flight distance.

Another type of device developed for the same purpose is the multi-reflection time-of-flight mass analyzer, in which the aforementioned loop orbit is replaced by a reciprocative path in which a reflecting electric field is created to make ions fly back and forth multiple times. Although the multi-turn time-of-flight type and multi-reflection time-of-flight type use different ion optical systems, they are essentially based on the same principle for improving the mass resolution. Accordingly, in the context of the present description, the "multi-turn time-of-flight type" should be interpreted as inclusive of the "multi-reflection time-of-flight type."

The multi-turn time-of-flight mass analyzer includes a multi-turn section in which ions are made to turn multiple times, an injector for injecting ions into the multi-turn section, and an ejector for extracting ions from the multi-turn section. The injector and ejector each have an ion-optical element that acts as a switch for creating a pulsed action to change the flight path of the ions, i.e. to deflect the ions or release them from their deflected state. These switches are hereinafter referred to as the injection switch and ejection switch, respectively. In most cases, the injection/ejection switch is realized by a deflecting electrode for changing the traveling direction of the ions. The injection switch can be used to control the mass range of the ions to be introduced into the multi-turn section. The ejection switch can be used to control the number of turns of the ions as well as other parameters.

As already stated, the multi-turn time-of-flight mass analyzer can achieve a high level of mass resolution. However, it has a drawback due to the fact that the flight path of the ions is a closed orbit. That is, the passing of ions: as the number of turns of the ions flying along the loop orbit increases, an ion having a smaller mass and flying at a higher speed passes another ion having a larger mass and flying at a lower speed. If the passing of ions having different masses occurs, it is possible that some of the peaks observed on the time-of-flight spectrum obtained by the measurement correspond to multiple ions that have completed different numbers of turns, i.e. those that have traveled different flight distances. In this case, it is impossible to uniquely relate the mass of the ions to their flight distance, so that the time-of-flight spectrum cannot be directly converted to a mass spectrum.

Taking into account this drawback, conventional multi-turn time-of-flight mass analyzers are normally used to realize a mass-zooming function intended for observing ions within a limited mass range where the passing of the ions produced by an ion source does not occur. This function is aimed at performing the measurement at a high mass resolution while limiting the target of observation to a relatively narrow mass range.

According to Non-Patent Document 1, the mass range, where no passing of the ions turning along the closed orbit occurs, is inversely proportional to the number of turns, so that the mass resolution and mass range of the measurement are also inversely proportional to each other. For example, if the ions are made to turn approximately one hundred times, the mass range where the passing of ions never occurs is reduced to a few percent as compared to the case where the ions are not made to turn. Therefore, if the sample requires high mass resolution and one must obtain a mass spectrum over a broad mass range for this sample, it is inevitable to perform a mass analysis while shifting the mass range for every analysis to obtain mass spectrums each covering a different mass range, and to eventually synthesize those mass spectrums to create a mass spectrum covering a broader mass range. Such a measurement requires a considerable length of time and seriously deteriorates the measurement throughput.

A method for expanding the mass range to be observed in the multi-turn time-of-flight mass analyzer is disclosed in Patent Document 4. According to this method, a multiple correlation function of a plurality of time-of-flight spectrums corresponding to different periods of time of ejection from the multi-turn section is calculated to reconstruct a single-turn time-of-flight spectrum from those time-of-flight spectrums. However, if there is only a small number of time-of-flight spectrums to be combined, this method may artificially create a false peak that does not really exist. Therefore, it is desirable to perform a mass analysis three or more times to obtain a plurality of time-of-flight spectrums for different periods of time of ejection from the multi-turn section. Thus, a measurement by this method also inevitably requires a long period of time. Furthermore, this method is also inefficient in that the calculation of the multiple correlation function generally involves complex operations that consume a considerable amount of time.

Patent Document 1: Japanese Unexamined Patent Application Publication No. H11-135060

Patent Document 2: Japanese Unexamined Patent Application Publication No. H11-135061

Patent Document 3: Japanese Unexamined Patent Application Publication No. H11-195398

Patent Document 4: Japanese Unexamined Patent Application Publication No. 2005-79049

Non-Patent Document 1: M. Toyoda et al,. "Multi-turn time-of-flight mass spectrometers with electrostatic sectors", *J. Mass Spectrom.*, 38, pp.1125-1142, 2003

DISCLOSURE OF THE INVENTION

Problem to be Solved by the Invention

The present invention has been developed in view of the aforementioned problems, and its objective is to provide a method and system for a multi-turn time-of-flight mass analysis in which no restriction is imposed on the mass range of the ions introduced into a closed orbit, i.e. a wide mass range of ions can be covered as the measurement target, and yet the ions are allowed to make the largest possible number of turns to achieve high levels of mass resolution.

Means for Solving the Problems

A first aspect of the present invention aimed at solving the aforementioned problems is a mass analysis method using a multi-turn time-of-flight ion optical system in which ions originating from a sample are made to fly repeatedly along a loop orbit and then, at a predetermined point in time or later than that, divert from the loop orbit to be detected by a detector, which is characterized by including:

a) a no-passing mode execution step for obtaining a time-of-flight spectrum by performing. a mass analysis of a target sample in a no-passing mode in which the ion is either prevented from completing one turn along the loop orbit or allowed to fly through the loop orbit a number of times within a range where any ion is assuredly prevented from lapping or passing another ion;

b) a peak information collection step for collecting information relating to a peak appearing on the time-of-flight spectrum obtained by an operation of the no-passing mode; and c) a timing determination step for predicting, based on the collected information relating to the peak, the number of turns and the time of flight corresponding to the peak to be observed when a mass analysis of the target sample is performed in a loop-turn mode in which the ion is made to fly through the loop orbit, and for determining the timing for beginning the diversion of the ion from the loop orbit so that at least a peak corresponding to the ion of interest can be separately identified on a time-of-flight spectrum based on the prediction.

A second aspect of the present invention aimed at solving the aforementioned problems is a mass analysis system for realizing the mass analysis method according to the first aspect of the present invention. More specifically, this mass analysis system includes a multi-turn time-of-flight ion optical system in which ions originating from a sample are made to fly repeatedly along a loop orbit and then, at a predetermined point in time or later than that, divert from the loop orbit to be detected by a detector, which is characterized by including:

a) a no-passing mode execution control means for obtaining a time-of-flight spectrum by performing a mass analysis of a target sample in a no-passing mode in which the ion is either prevented from completing one turn along the loop orbit or allowed to fly through the loop orbit a number of times within a range where any ion is assuredly prevented from lapping or passing another ion;

b) a peak information collection means for collecting information relating to a peak appearing on the time-of-flight spectrum obtained by an operation of the no-passing mode; and c) a timing determination means for predicting, based on the collected information relating to the peak, the number of turns and the time of flight corresponding to the peak to be observed when a mass analysis of the target sample is performed in a loop-turn mode in which the ion is made to fly through the loop orbit, and for determining the timing for beginning the diversion of the ion from the loop orbit so that at least a peak corresponding to the ion of interest can be separately identified on a time-of-flight spectrum based on the prediction.

The "loop orbit" in the present invention includes not merely the loop orbit in a narrow sense, such as a circular or elliptical orbit, in which no portions of the path followed by the ion during one turn overlap each other; it should be more widely interpreted. For example, a linear or curved reciprocative path along which ions can fly back and forth is also a "loop orbit," in which case it is evident that one turn means one round trip.

The ion optical system in the first and second aspects of the present invention normally includes an electric field or magnetic field for forming the loop orbit, an injector for introducing an externally produced ion into the loop orbit, and an ejector for diverting the ion from the loop orbit. However, it is also possible to produce an ion at a certain point on the loop orbit, in which case the system does not include the injector. As the ejector, one can use an ejection switch for changing the traveling direction of the ion so as to divert the ion from the loop orbit.

The present multi-turn time-of-flight ion optical system has two major measurement modes, the no-passing mode and loop-turn mode. In the no-passing mode, ions are introduced through the injector into the loop orbit and made to fly through a portion of the loop orbit, to be eventually introduced through the ejector to the detector without completing one turn, or otherwise the introduced ions are made to fly through the loop orbit an adequately small number of times that assuredly prevents the lapping or passing of ions having different masses while they are flying along the loop orbit. When the measurement of a target sample is performed in the no-passing mode, the lapping or passing of ions having different masses will not occur on their flight path, so that the ions reach the detector in descending order of their velocity, i.e. in ascending order of their mass. Therefore, on the resultantly obtained time-of-flight spectrum, it is possible to determine the masses of all the observed peaks.

Accordingly, in the mass analysis system according to the second aspect of the present invention, which realizes the mass analysis method according to the first aspect of the present invention, the no-passing mode execution means initially obtains a time-of-flight spectrum in the no-passing mode by appropriately controlling, for example, the voltages applied to the injector, the ejector, and the electrodes creating an electric field forming the loop orbit. Subsequently, the peak information collection means collects information about each peak located on the time-of-flight spectrum. The peak information should include at least the time of flight of the peak.

The process of collecting peak information may be performed for only some peaks selected based on a predetermined condition rather than for all the peaks appearing on the time-of-flight spectrum. The "predetermined" condition is, for example, that any peak having a peak intensity equal to or greater than a preset threshold value should be selected. Selecting appropriate peaks in this manner is advantageous to removing noise peaks having low intensities or excluding the peaks originating from the ions that the user is not (or is unlikely to be) interested in.

Based on the peak information collected in the previously described manner, the timing determination means predicts the number of turns and the time of flight corresponding to the peak to be observed when a mass analysis of the target sample is performed in a loop-turn mode, and determines the timing for beginning the diversion of the ion from the loop orbit so that at least a peak corresponding to the ion of interest can be separately identified on a time-of-flight spectrum based on the prediction, i.e. so that the ions having different masses and making different numbers of turns will not be mixed together before reaching the detector.

In one specific example, a plurality of regions in which the mass and the time of flight can be uniquely determined are initially defined on the time-of-flight axis of the time-of-flight spectrum based on the aforementioned prediction. That is to say, it is guaranteed that the peaks included in any one of these regions correspond to the ions that have made the same number of turns, so that their masses can be uniquely determined from their times of flight. If any of these regions overlap each other and a peak is included in the overlapped range, it is impossible to definitely know the number of turns of the ion corresponding to this peak and its mass cannot be determined. This situation can be avoided by appropriately determining the timing for the diversion of the ions from the loop orbit under the condition that none of the plurality of regions should overlap each other, or even if any of these regions overlap another, no peak should exist within the overlapped range.

Reducing the number of turns lowers the mass resolution. Therefore, if the required mass-resolution level is previously specified, there should naturally be a lower limit of the number of turns depending on the required level. Taking this into account, the timing determination means may roughly determine the number of turns of a specific ion (e.g. the ion having the smallest mass) according to the specified mass resolution or set a lower limit of the number of turns of the ion having the smallest mass, before determining the timing to satisfy the aforementioned condition.

The mass analysis system according to the second aspect of the present invention may further include:

d) a loop-turn mode execution control means for performing the mass analysis of the target sample in the loop-turn mode at the timing for beginning the diversion of the ion determined by the timing determination means; and e) a mass identification means for identifying the mass of an ion corresponding to a peak appearing on a thereby obtained time-of-flight spectrum, based on the actual time of flight of the peak and the number of turns predicted by the timing determination means.

The time-of-flight spectrum actually obtained in the loop-turn mode has a mass resolution higher than in the case of the no-passing mode, so that it is possible that some peak that was identified as a single peak in the no-passing mode be clearly separated into multiple peaks, or some peak be slightly dislocated from the predicted position due to the causes of error or other reasons. Even in such cases, there will be no peak in which two or more ions having different masses are mixed together, so that the number of turns of an ion corresponding to each peak is definitely determined. Therefore, by using the predicted number of turns, it is possible to determine, or identify, the mass of each peak from its actual time of flight.

Effect of the Invention

By the mass analysis method and mass analysis system according to the first and second aspects of the present invention, performing a measurement in the no-passing mode one time followed by a measurement in the loop-turn mode one time, is, in most cases, sufficient to identify the masses of the ions corresponding to the peaks appearing on a time-of-flight spectrum obtained in the loop-turn mode. In the loop-turn mode mass analysis, the passing of ions having different masses may occur, which consequently makes it possible to identify the mass of the ions over a much broader mass range yet with higher mass resolutions than ever before. Since it is unnecessary to repeat a measurement with a limited mass range, the entire measurement requires a shorter period of time. Thus, the measurement throughput is improved. Furthermore, it is unnecessary to perform complex calculations, such as the calculation of a multiple correlation function.

BRIEF DESCRIPTION OF THE DRAWINGS

FIG. 6 is a table showing the mass, the number of turns and other detailed information relating to each segment obtained by the simulations of FIGS. 4 and 5.

FIG. 7 is a table showing the result of a calculation for correcting the mass of the peaks observed in the loop-turn mode and the original data generated from random numbers.

EXPLANATION OF NUMERALS

1 . . . Ion Source
2 . . . Loop Orbit
2' . . . Reciprocative Path
2*a*, 2*b* . . . Sector-Shaped Electrode
3 . . . Injection Switch
4 . . . Ejection Switch
5 . . . Ion Detector
10 . . . Controller
11 . . . Orbit Voltage Generator
12 . . . Injection/Ejection Voltage Generator
13 . . . Data Processor
14 . . . Input Unit

BEST MODE FOR CARRYING OUT THE INVENTION

Figure 1:
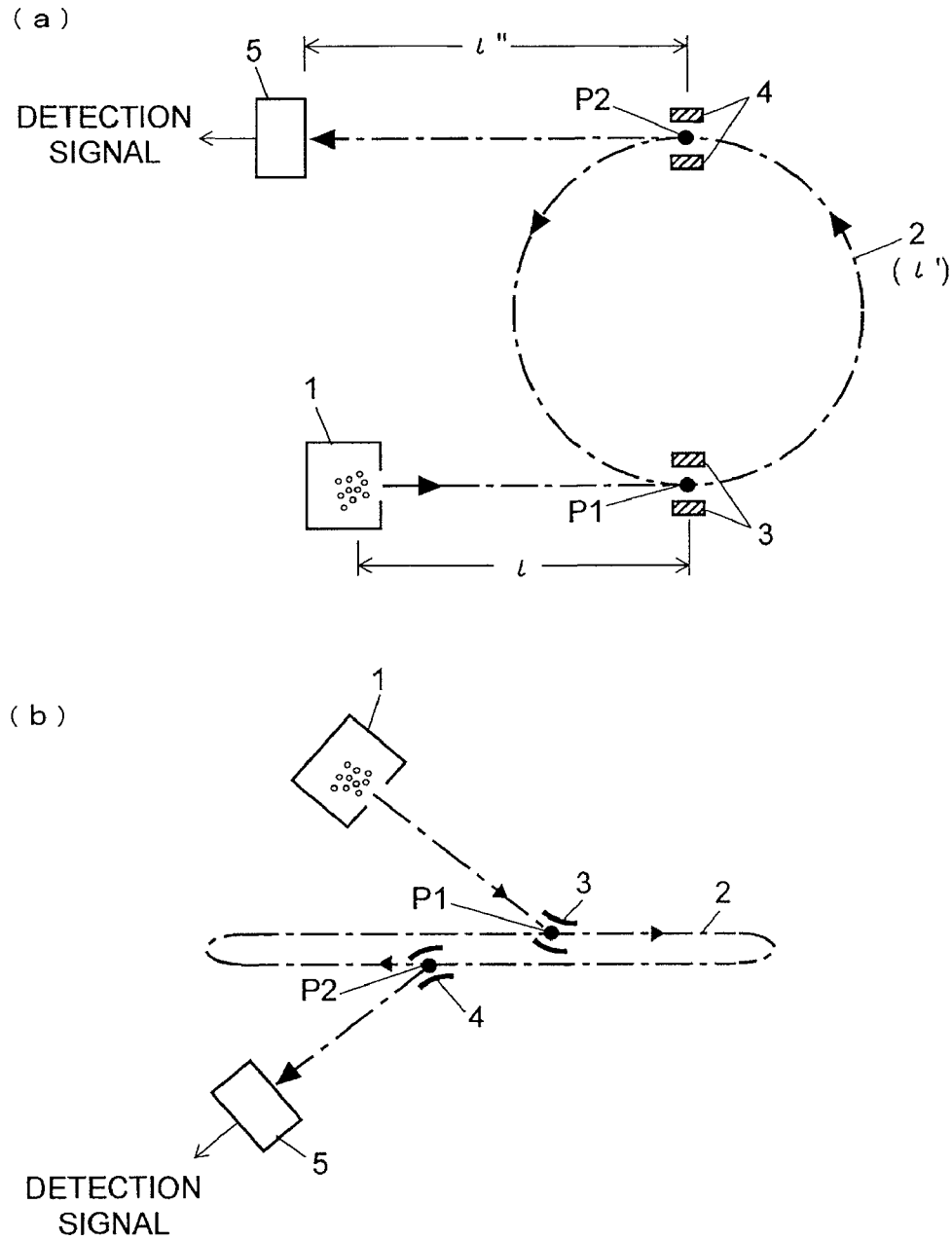
FIG. 1 is a schematic diagram of an ion optical system of a multi-turn time-of-flight mass spectrometer according to one embodiment of the present invention.
Figure 2:
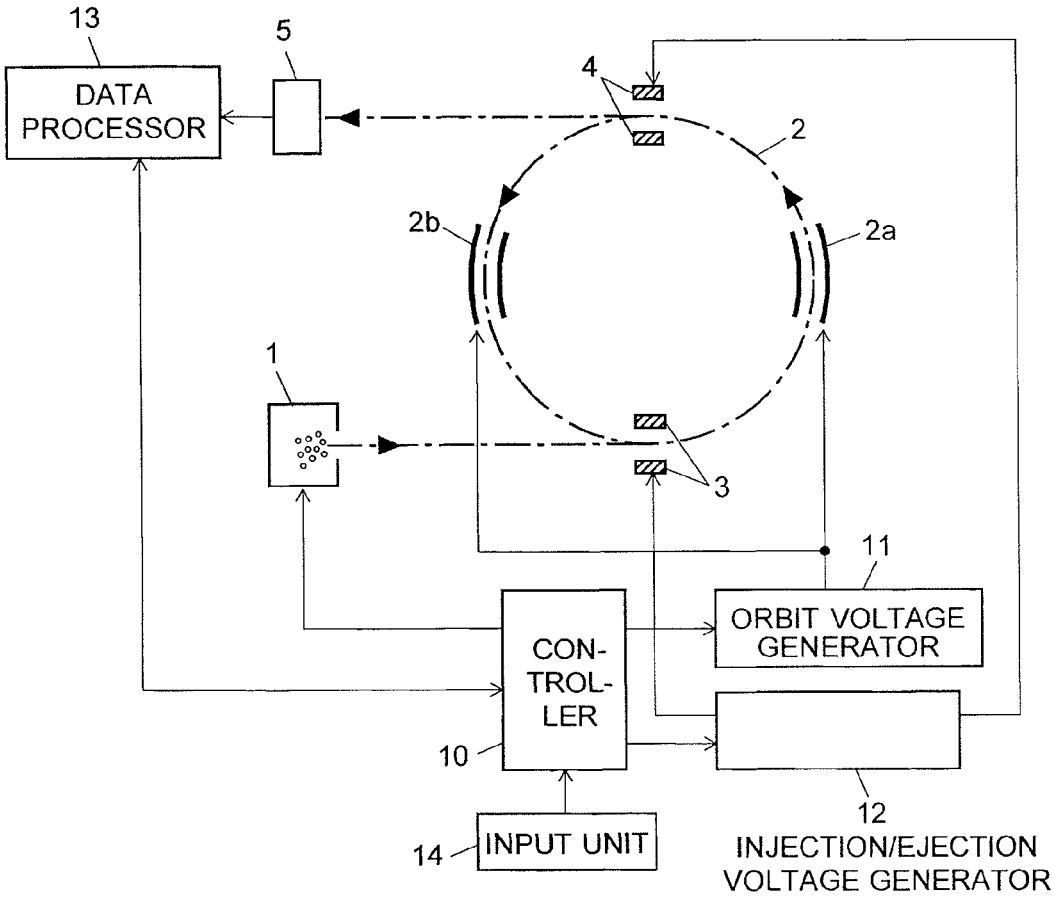
FIG. 2 is an overall configuration diagram showing a multi-turn time-of-flight mass spectrometer using the ion optical system of FIG. 1.

Hereinafter, the configuration of a generally used multi-turn time-of-flight mass spectrometer is initially described. FIG. 1(*a*) is a schematic diagram showing an ion optical system of a generally used multi-turn time-of-flight mass spectrometer, and FIG. 2 is an overall configuration diagram of a multi-turn time-of-flight mass spectrometer using this ion optical system.

An ion source 1 ionizes sample molecules into various kinds of ions and supplies these ions with a predetermined amount of energy to make them begin to fly. Alternatively, the ion source 1 may be designed similar to a three-dimensional quadrupole ion trap or other devices that temporarily hold a group of externally generated ions and simultaneously supply these ions with a predetermined amount of energy to make them begin to fly.

After beginning their flight from the start point, i.e. the ion source 1, the ions are introduced into a loop orbit 2 through a deflecting electric field created by an injection switch 3. For example, the loop orbit 2 is formed by the effect of a plurality of sector-shaped electric fields each generated by a plurality of sector-shaped electrodes 2*a* and 2*b*, as shown in FIG. 2. It should be noted that FIG. 2 shows only some of the sector-shaped electrodes; in practice, it is necessary to use a greater number of sector-shaped electric fields. The loop orbit 2 in the figure has a circular shape, which is a mere example and the loop orbit 2 can have various kinds of shapes, such as a substantially elliptical shape or "figure-8" shape.

After flying through one-half of the loop orbit 2 or turning along the loop orbit 2 one or more times, the ions are diverted from the loop orbit 2 through a deflecting electric field created by an ejection switch 4. The diverted ions arrive at, and are detected by, an externally provided ion detector 5. The detection signals of the ion detector 5 are sent to a data processor 13, which performs the necessary data processing, such as converting the time of flight of each ion to mass, creating mass spectrums, and performing qualitative and quantitative analyses.

An orbit voltage generator 11 applies a predetermined DC voltage to each of the sector-shaped electrodes 2*a* and 2*b* to create a sector-shaped electric field. An injection/ejection voltage generator 12 applies a deflecting voltage for injecting ions into the loop orbit 2 and a deflecting voltage for ejecting ions from the loop orbit 2 to the injection switch 3 or the ejection switch 4, respectively, at predetermined timings. A controller 10 controls these voltage generators 11 and 12, ion source 1, data processor 13 and other components to perform a mass analysis operation, which will de described later. The input unit 14 is used to manually enter various parameters necessary for the analysis.

In FIG. 1, the numerals ι, ι' and ι" respectively denote the distance from the ion source 1 to the injection point P1 to the loop orbit 2 (this section is hereinafter referred to as the "injecting section"), the length of the path for the no-passing (no-turn) mode in which the ions fly through only one-half of the loop orbit 2, and the distance from the ejection point P2 from the loop orbit 2 to the ion detector 5 (this section is hereinafter referred to as the "ejecting section"). The flight distance in the no-passing mode is given by L0=ι+ι'+ι". The circumferential length of the loop orbit 2 is L. Naturally, every apparatus has a different ion optical system, and the configuration shown in FIG. 1 may be changed to various forms. For example, it is possible to set ι=0, in which case the ion source 1 is located on the loop orbit 2.

FIG. 1(*b*) shows the configuration of another ion optical system, in which an ion that has begun its flight from the ion source 1 is introduced through the injection switch 3 into a linear reciprocative path 2' and then made to fly back and forth a plurality of times, after which the ion is diverted through the ejection switch 4 and detected by the ion detector 5. The reciprocative path 2' can be formed by providing reflecting electrodes at both ends of the path. Similar to the loop orbit 2, the reciprocative path 2' is also a type of closed path and can be regarded as a loop orbit in the broad sense. Therefore, it is evident that the mass analysis method according to the present invention is also applicable to this path.

The relationship between the mass and the time of flight of an ion in the configuration of the ion optical system shown in FIG. 1 is hereinafter described. In the following mathematical calculation, V denotes the ion-accelerating voltage in the ion source 1, e denotes the elementary electric charge, m denotes the mass of an ion, and the valence number of the ion is one. For a multivalent ion whose valence number z is not one, m can be replaced by m/z.

Under these conditions, the relationship between the mass m and the time of flight $t_0$ of the ion in the no-passing mode is given by:

$$t0 = \frac{L_0}{\sqrt{2eV}}\sqrt{m} \tag{1}$$

On the other hand, in the loop-turn mode, in which ions fly along the loop orbit 2 one or more times, let us consider the case where an ion of mass m has flown n times through the loop orbit 2 and arrives at, and is detected by the ion detector 5. In this case, the time of flight t of the ion is calculated by:

$$t = \frac{L_0 + nL}{\sqrt{2eV}}\sqrt{m} = \frac{L_0}{\sqrt{2eV}}(1+\alpha_n)\sqrt{m}, \quad \alpha = L/L_0 \tag{2}$$

From equations (1) and (2), the relationship between the time of flight t in the loop-turn mode and the time of flight $t_0$ in the no-passing mode can be obtained as follows:

$$t=t_0+\alpha t_0 n \tag{3}$$

The problem of the passing of ions in the time-of-flight (TOF) spectrum obtained in the loop-turn mode is evident in equation (2). This equation (2) includes two unknown variables, the number of turns n and the mass m, for one observed value of the time of flight t. Even if the number of turns n is unknown, if it is guaranteed that the same number of turns n applies to all the masses, it is possible to know this number of turns n by performing the measurement using a standard sample of a known mass. Using this value of n, one can determine the mass m from a time of flight t. However, as already explained, when in the loop-turn mode, the passing of ions having different masses may occur, causing the number of turns to be different for each peak appearing on the time-of-flight spectrum. In this case, it is impossible to uniquely determine both unknown variables in equation (2), i.e. the mass m and the number of turns n, for an observed time of flight t. As explained earlier, a commonly used conventional technique for this problem is to limit the range of observation to a mass range where no passing can occur.

The reason for putting such a limitation to the mass range to be measured is that, if a passing occurs, the mass and number of turns in equation (2) cannot be uniquely determined. By contrast, in the mass analysis method according to the present invention, by using a TOF spectrum obtained in the no-passing mode without causing the lapping or passing of ions, a TOF spectrum obtained in the loop-turn mode in which a passing has occurred is divided into regions in which both the mass and the number of turns can be uniquely determined for all the observed ion packets or for specific ion packets of interest. An "ion packet" is a collection of ions with the same mass which are moving in a finite spread form in the temporal direction due to an unevenness in the acceleration energy or other factors.

From equation (3), which shows the relationship between the time of flight in the no-passing mode and that in the loop-turn mode, it is evident that, for any value of n, the time of flight t should be observed on a straight line with an intersect of $t_0$ and inclination of $\alpha t_0$. Since the number of turns is always an integer value, it can be understood that an ion packet observed at a time of flight $t_0$ in the no-passing mode can take only specific times of flight, i.e. at intervals of $\alpha t_0$ from $t_0$, when observed in the loop-turn mode. Owing to this nature, it is possible predict the times of flight in the loop-turn mode for all the ion packets contained in an objective sample, the measurement target, by initially observing a TOF spectrum obtained in the no-passing mode without causing the passing of the ions over the entire mass range (practically, over a considerably wide mass range). On the time-of-flight spectrum in the no-passing mode, each ion packet appears as a peak with a certain temporal width. Therefore, the time of flight predicted for the loop-turn mode should also appear as an area whose width depends on the peak width observed in the no-passing mode. In the following description, a time-of-flight region predicted for the loop-turn mode from a peak on a TOF spectrum in the no-passing mode is referred to as a "segment."

It is herein supposed that a peak observed at a time of flight $t_0$ in the no-passing mode is associated with an ion packet having a time-of-flight variation of $\Delta t$. The time-of-flight variation is naturally proportional to the peak width and may exactly equal the full width of the peak or be adjusted to a smaller value by dividing the peak width by an appropriate number. The time-of-flight variation defined for a peak observed in the no-passing mode is hereinafter referred to as an "initial time width."

In the case of making the ion packet fly through the loop orbit n times in the loop-turn mode, the width $\Delta t_n$ of the segment in the loop-turn mode corresponding to the initial time width $\Delta t$ can be known from equation (3) as follows:

$$\Delta t_n=(\iota+\alpha_n)\Delta t \tag{4}$$

It is possible that a group of ion packets that were observed as a single peak due to an insufficient mass resolution in a no-passing-mode measurement are observed as a plurality of peaks in a loop-turn mode measurement performed with a sufficient mass resolution (refer to the segment SG8 in FIG. 5, which will be mentioned later). Even in such a case, if the time-of-flight difference between the ion packets is smaller than the initial time width, those peaks should be found within the same segment having a width given by equation (4), so that the mass and number of turns of all the peaks can be uniquely determined.

In order that a segment that will be observed in the loop-turn mode can be predicted from a TOF spectrum obtained in the no-passing mode, it is necessary that the segments observed in the loop-turn mode should not overlap each other, or even if some of them overlap, no peak should be observed within the overlapped portion. If a peak is observed within a range where the overlapping of the segments has occurred, it means that the peak has two or more combinations of the mass and the number of turns to be predicted from the result of the no-passing-mode measurement, so that these values cannot be uniquely determined. The overlapping of the segments can be rather easily avoided by regulating the timing of the ejection switch 4. In other words, searching for a condition for avoiding the overlapping of the segments is nothing other than determining an appropriate timing for operating the ejection switch 4. Accordingly, an example of the simplest method of avoiding the overlapping of the segments is hereinafter described.

To begin with, the peak position $t_{0i}$ and initial time width $\Delta t_{0i}$, are determined for each of all the observed peaks (or some specific peaks of interest) from the TOF spectrum in the no-passing mode. It is herein assumed that N peaks have been observed. The peak position may be the top of the peak, the center of gravity of the peak, or any other value representative of the location of the peak. As already stated, the initial time width has a degree of freedom for adjustment; reducing the initial time width decreases the segment width in the loop-turn mode, making it easier to avoid the overlapping of the segments.

It is herein supposed that an ion packet #1 having the shortest time of flight and hence the smallest mass is made to fly along the loop orbit $n_1$ times. The ejection switch 4 is switched from the loop orbit 2 to the ejection ion optical system immediately before the ion packet #1 completes the $n_1$-th turn. This switching operation ensures that the peak having the shortest time of flight in the TOF spectrum in the loop-turn mode corresponds to the ion packet #1. After the timing of switching the ejection switch 4 is determined by setting the number of turns for the ion packet #1, it is possible to predict the number of turns for each of all the subsequent ion packets as follows.

Given that the ejection switch 4 is switched d seconds before the ion packet #1 passes through the ejection switch 4, the point in time Ts for switching the ejection switch 4 can be expressed as follows:

$$Ts = \frac{l+l'}{L_0}t_{01} + \alpha n_1 t_{01} - d \tag{5}$$

Given this value, the numbers of turns $n_i$ of the other ion packets #i can be determined as an integer value that satisfies the following equation.

$$\frac{1}{\alpha t_{0i}}\left(Ts - \frac{l+l'}{L_0}t_{0i}\right) < n_i < \frac{1}{\alpha t_{0i}}\left(Ts - \frac{l+l'}{L_0}t_{0i}\right) + 1 \tag{6}$$

From equation (6) and the specified point in time Ts for switching the ejection switch 4, the number of turns $n_i$ can be predicted for all the ion packets. Furthermore, substituting the predicted number of turns $n_i$ into equation (3) gives a predicted value of the time of flight $t_i$. In this manner, one can predict the number of turns and time of flight in the loop-turn mode for all the peaks or some specific peaks observed in the no-passing mode.

Subsequently, a judgment for avoiding the overlapping of the segments is made as follows: After the number of turns has been predicted in the previously described manner, the segment time width $\Delta t_i$ corresponding to the initial time width $\Delta t_{0i}$ is calculated by equation (4). For the predicted time of flight $\Delta t_{0i}$ , and segment time width $\Delta t_i$, one of the following two conditional expressions (a) and (b) is selected, and whether or not the selected expression holds true is determined for every possible combination of the peaks observed in the no-passing mode:

$$|t_i-t_j|>\Delta t_i/2 \tag{a}$$

$$|t_i-t_j|>(\Delta t_i-\Delta t_j)/2 \tag{b}$$

From these conditional expressions, it is evident that expression (b) imposes the more rigorous condition for the determination of the overlapping of the segments; expression (b) guarantees the perfect separation of all the segments. On the other hand, expression (a) allows the overlapping, to some extent, of the segments yet guarantees that no peak exist within the overlapped portion. If the selected conditional expression holds true for all combinations of the peaks, it is possible to set a segment within which both the mass and the number of turns can be uniquely determined in the TOF spectrum in the loop-turn mode. By contrast, if there is any combination of the peaks for which the selected conditional expression does not hold true, it is impossible to uniquely determine the masses of all the peaks for the number of turns in question. Accordingly, the operation returns to the initial step and the judgment of the overlapping of the segments is performed by following the previously described procedure after the number of turns is varied, for example, by increasing or decreasing the number of turns of the ion packet #1 by one.

This trial-and-error process is repeated to search for the number of turns at which the overlapping of the segments can be avoided. It should be noted that, as shown in equation (4), increasing the number of turns widens the segment time width, which results in a higher probability of the overlapping of the segments. As a result, in some cases it will be necessary, for example, to switch to the less rigorous expression (a) or adjust the initial time width so as to reduce the segment time width. If none of these measures succeed in finding an appropriate setting of the segments, it will be necessary take other measures, such as reducing the number of peaks of interest.

As described to this point, by using a passing-free TOF spectrum obtained in the no-passing mode, a TOF spectrum in the loop-turn mode, which involves the passing of the ions, can be divided into segments in which the mass and the number of turns of the ions can be uniquely determined. It is guaranteed that the number of turns is the same irrespective of whether the number of peaks included in each segment in the TOF spectrum in the loop-turn mode is one or more, and the mass can be uniquely determined from the time of flight of each of these peaks. The timing for switching the ejection switch 4 can also be determined from the mass values. The controller 10 conducts the measurement in the loop-turn mode while controlling the injection/ejection voltage generator 12 so as to switch the ejection switch 4 according to the timing thus determined, and the data processor 13 creates a TOF spectrum base on the detection signals obtained by the measurement. In the TOF spectrum thus obtained, the mass of each ion can be calculated with high mass resolution from the actual time of flight of the ion and the number of turns predicted in the previously described manner.

Figure 3:
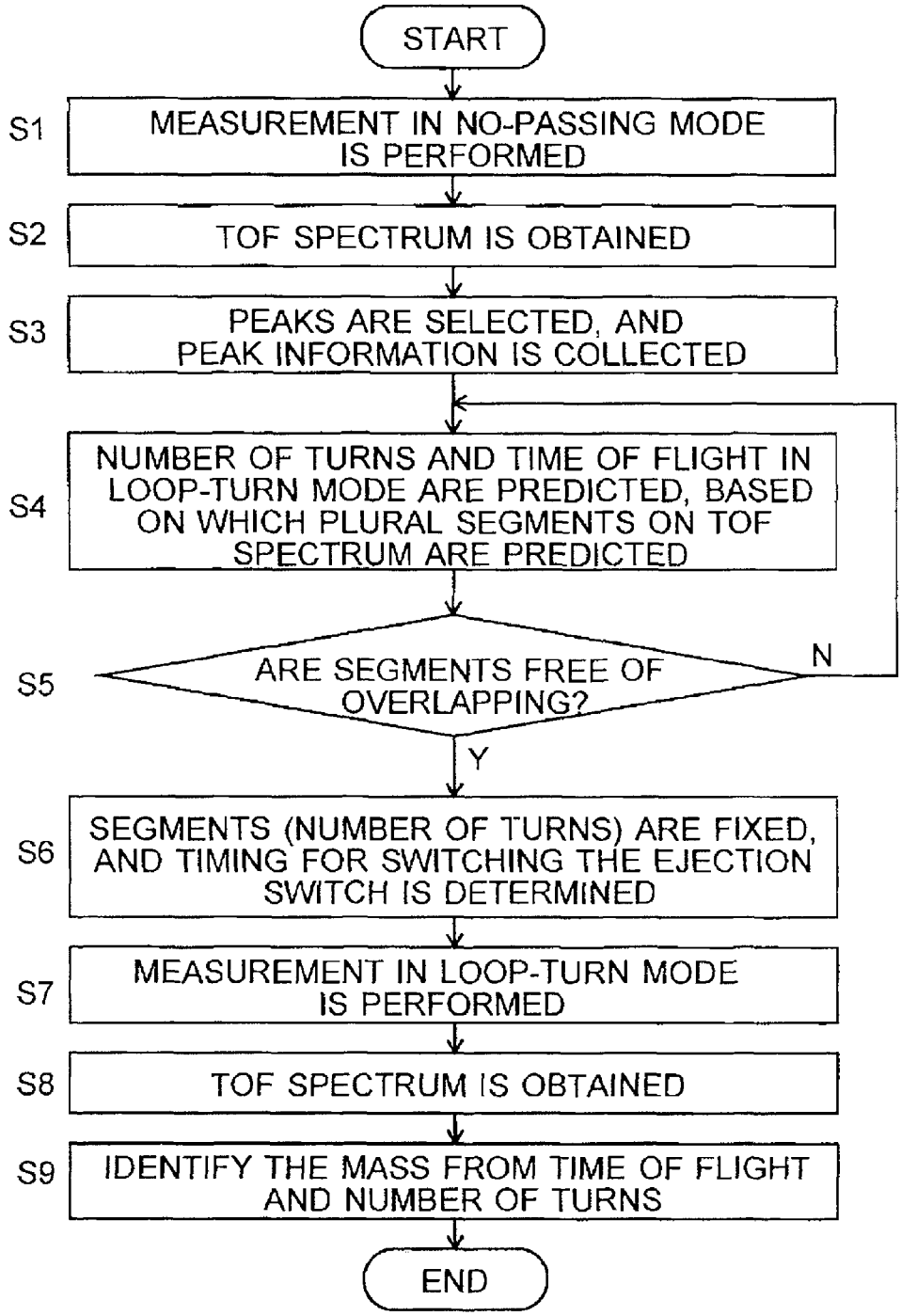
FIG. 3 is a flowchart showing the steps of a mass analysis according to one embodiment of the preset invention.

FIG. 3 is a flowchart summarizing one example of the procedure of the previously described mass analysis method according to the present invention.

First, a no-passing-mode measurement is performed on a target sample to obtain a TOF spectrum showing the relationship between the time of flight and the ion intensity (Steps S1 and S2). Next, the following process is performed in the data processor 13: A peak detection is performed on the TOF spectrum to determine the time of flight and the intensity of each peak. In order to exclude various kinds of generally known noise peaks included in the spectrum and extract only the peaks of interest, a predetermined number of peaks (e.g. 15 peaks) are selected in descending order of intensity from a group of peaks whose intensities are not lower than a predetermined threshold, and the time of flight and other kinds of information of the selected peaks are collected (Step S3). It should be noted that this selection process is not mandatory; it is merely an optional process, in which the peak selection conditions can be arbitrarily specified.

Subsequently, the initial time width and other parameters for each of the selected peaks are specified in the previously described manner, after which the mass and the time of flight in the loop-turn mode are predicted under certain conditions (e.g. with a provisional number of turns of the ion having the smallest mass), and a plurality of segments to be observed in the TOF spectrum in the loop-turn mode is defined according to the prediction (Step S4). Then, it is determined whether these segments are free of overlapping (or whether any peak exists in the overlapped portion if such an overlapped portion exists) (Step S5). If the mass and the time of flight of any peak cannot be uniquely determined due to the presence of an overlapped portion of the segments or for any other reasons, the process returns to Step S4 to modify the previously assumed conditions of the loop-turn mode measurement and define the segments once more. With the segments thus updated, it is once more determined whether they have any overlapped portion.

After a set of segments in which the mass and the time of flight can be uniquely determined have been found, the segment setting is fixed, and the number of turns and other information corresponding to each segment are stored in a memory. By fixing the segment setting, the timing for switching the ejection switch 4 is also determined; this information is given to the controller 10 (Step S6). Subsequently, under the command of the controller 10, a loop-turn mode measurement of the target sample is performed, and a TOF spectrum in the loop-turn mode is created in the data processor 13 (Steps S7 and S8). From the positions of the peaks appearing in this TOF spectrum, the accurate time of flight of each peak is determined, and the mass of each peak is calculated from the obtained time of flight and the previously stored information indicative of the number of turns of each segment (Step S9). Thus, even if the passing of ions occurs in the loop-turn mode measurement, the mass of an ion corresponding to each peak having a different number of turns on the TOF spectrum can be obtained with high mass resolution.

EXAMPLE

To verify the effectiveness of the technique used in the previously described mass analysis method according to the present invention, a simulation was performed as follows.

The simulation assumed that the system had a configuration shown in FIG. 1(*a*), with $\iota=\iota'\iota''=0.5$ [m] and L=1.0 [m]. The ion-accelerating voltage was 10 kV. The sampling rate for signal observation was 1 GS per second. The ions to be measured were simulated by generating random numbers, which represented the number of existing ion packets and the mass and intensity of each ion. A restriction due to the structure of the ion optical system was imposed on the mass range for generating the ions, as will be hereinafter described.

While introducing ions into the loop orbit 2, the injection switch 3, which is used for guiding ions from the ion source 1 into the loop orbit 2, is supplied with a voltage to deflect the ions. While the ions are flying through the loop orbit 2, this voltage must be set to zero to discontinue the generation of the deflecting electric field. Accordingly, the time frame within which ions can be introduced into the loop orbit 2 is determined by the length of time from the point when the ions are released from the ion source 1 to the point when the lightest and fastest ion packet, which is the first to go into the loop orbit 2, completes its first turn through the loop orbit 2 and returns to the injection switch 3. Provided that $m_{min}$ and $m_{max}$ respectively denote the minimum and maximum masses to be observed, the mass range within which ions can be introduced into the loop orbit 2 is calculated by equation (7).

$$\frac{m_{max}}{m_{min}} = \left(1 + \frac{L}{L_0}\right)^2 \tag{7}$$

This nature must be taken into consideration when combining a TOF spectrum in the no-passing mode and a TOF spectrum in the no-passing mode. Naturally, the TOF spectrum observed in the no-passing mode has no such restriction on the mass range as previously described. The operator of the present system must take this point into account when conducting a measurement, otherwise an inconsistency in the mass range may arise between the no-passing mode and the loop-turn mode, which makes the peak identification impossible in principle. A realistic measure to equalize the mass ranges in both modes is to perform the no-passing-mode measurement with the injection switch 3 being operated in the same manner as in the loop-turn mode, although this switching operation is practically unnecessary in the no-passing mode.

In this simulation, the smallest mass to be generated by the random numbers was initially chosen, after which the other masses were generated within a mass range that satisfied equation (7). The maximum number of ion packets was set at 20, among which five ion packets were generated so that they had a mass difference that required a mass resolution of 10000. The smallest mass of these five ion packets was also generated by a random number. Under this condition, the five ion packets that require a mass resolution of 10000 cannot be separated when the system is in the no-passing mode. The signal intensity of each ion packet was generated within a range from 0.1 to 1. As for the characteristics of the ion optical system, it was assumed that the peak shape of the observed signal was a Gauss type with a half-width of approximately 10 [ns], and that the observed signal would not be attenuated due to the loop flight.

Figure 4:
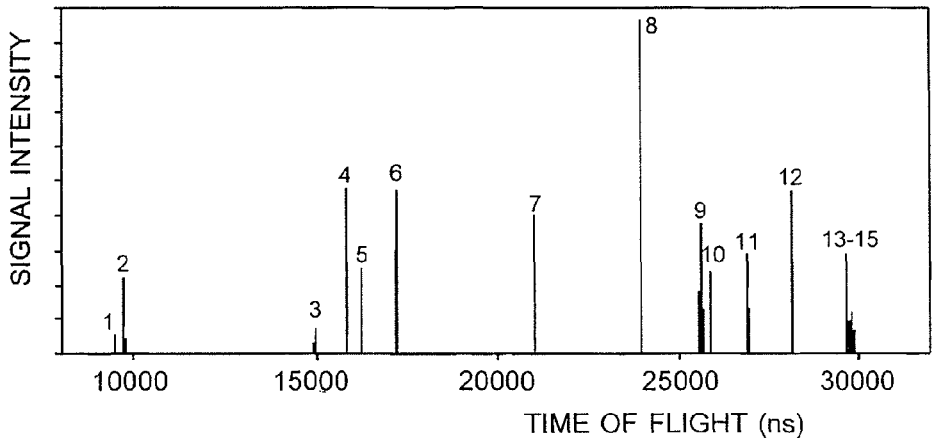
FIG. 4 is an example (simulation result) of a time-of-flight spectrum obtained in the no-passing (no-turn) mode.

A TOF spectrum obtained as a result of the simulation of a measurement in the no-passing mode under the previously described conditions is shown in FIG. 4. As is evident from FIG. 4, a total of 15 peaks (denoted by the FIGS. 1 to 15) are observed in this no-passing-mode TOF spectrum. At this point in time, the operator does not know whether all the ion packets originating from the target sample have been separated or not. Subsequently, a measurement in the loop-turn mode is initiated.

To leave some margin for the mass resolution, the measurement was performed on the assumption that the ion packet #1 having the smallest mass be made to fly through the loop orbit approximately 100 times. The reason for stating "approximately" 100 times and not "exactly" 100 times was because it was expected that the timing of the ejection switch 4 would necessarily be adjusted so as to avoid the overlapping of the segments in the previously described manner. For the overlap determination of the segments, the expression (a) was used. The initial time width in the no-passing mode was assumed to be one-tenth of the full width of the peak.

Figure 5:
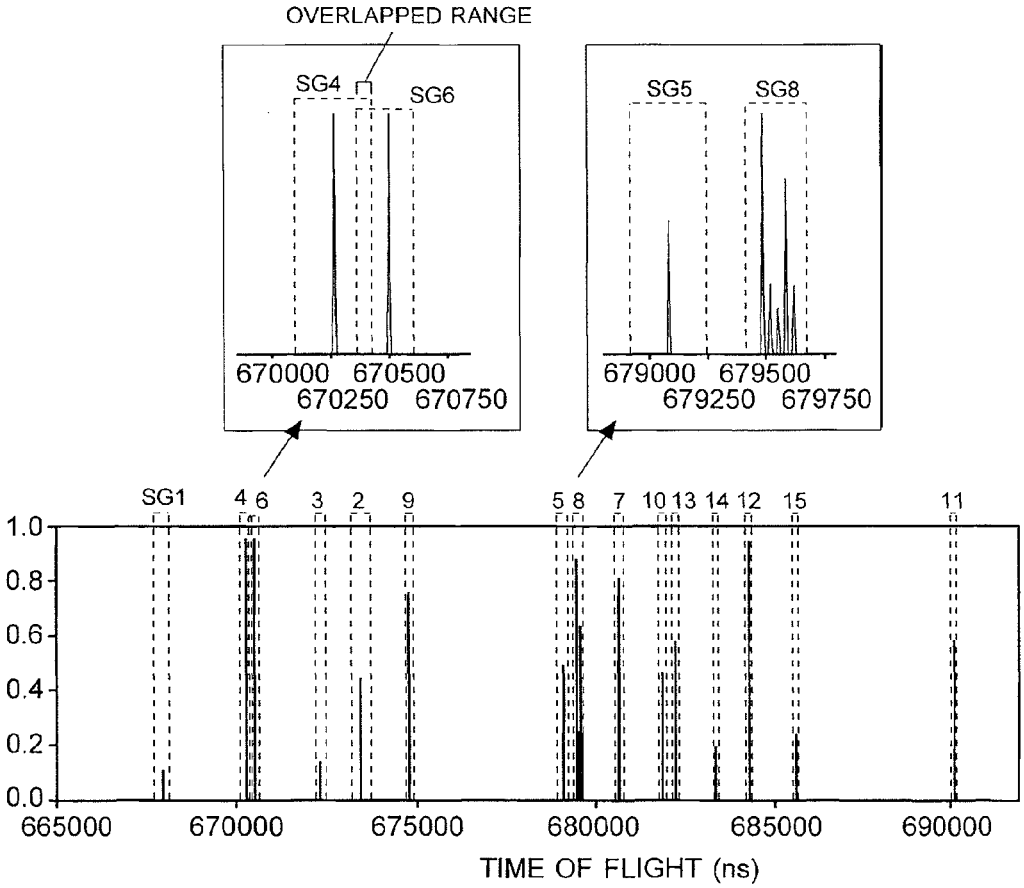
FIG. 5 is an example (simulation result) of a time-of-flight spectrum obtained in the loop-turn mode.

FIG. 5 shows a TOF spectrum obtained by a loop-turn-mode measurement in which the ejection switch 4 was operated at a timing of ejection determined by a process for avoiding the aforementioned overlapping of the segments. The number of turns of the ion packet having the smallest mass was initially set at 100. However, as a result of the segment overlap determination, the actual measurement was performed with 104 turns. This means that it was impossible to find a segment setting that satisfies equation (a) when the number of turns was from 100 to 103.

FIG. 5 also shows the fifteen segments SG1 to SG15, determined by calculation, along with the TOF spectrum. The numbers assigned to the segments correspond to the peak numbers on the no-passing-mode TOF spectrum shown in FIG. 4. In the loop-turn-mode TOF spectrum shown in FIG. 5, it can be confirmed that no segments other than the segments SG4 and SG6 have overlapped portions and no peak is present within the overlapped region of the segments SG4 and SG6. It should be noted that this is the result of the use of equation (a) for the overlap determination of the segments. For example, when equation (b) is used for the determination, the overlapping of the segments SG4 and SG6 is disallowed.

Detailed data of the result in FIG. 5, such as the mass and the number of turns of each segment, are shown in FIG. 6. In this figure, "range" is the time-of-flight range of each segment in the loop-turn mode, "linear" is the time-of-flight range of each segment in the no-passing mode, and "lap" is the number of turns. As can be seen from this result, the mass and the number of turns ("lap") are uniquely determined within each segment, and the peak position (time of flight) can be converted to the mass. For the mass conversion, one needs only to calculate the mass of the peak, for each segment, from the time of flight and the number of turns.

Furthermore, for example, there are five peaks observed in segment SG8. This reveals that the peak PK8, which was observed as a single peak in the no-passing mode, was in fact a mixture of five ion packets with different masses. By the loop-turn-mode measurement, a total of 19 peaks have been observed. The calculated result of the mass conversion of all these peaks, along with the original mass-value data generated by random numbers, are shown in FIG. 7. This result demonstrates that all the generated ion packets have been successfully identified. Another noteworthy point is the agreement of the calculated mass values with the original data, which proves that the mass identification in the mass analysis method according to the present invention has a fundamental superiority to conventional techniques in terms of mass accuracy. Therefore, when the mass analysis method according to the present invention is adopted, the mass accuracy depends solely on actual perturbations, such as the working and assembling precisions of the ion optical system, the stability of the power source, or the peak-shape variation due to the ion-optical characteristics.

The no-passing mode in the previous description makes ions fly through only one half of the loop orbit and hence can be called a "no-loop" mode. It is evident that in real cases the no-passing mode may be such a mode in which the ions make a relatively small number of turns within a range where it is guaranteed that none of the ions having different masses can lap or pass any other ion. That is to say, what needs to be guaranteed is that the ions arrive at the ion detector in ascending order of their mass. The number of turns that is adoptable for the no-passing mode can be calculated if, for example, the upper and lower limits of the mass of the ions are known.

It should be noted that the foregoing embodiment is a mere example of the present invention, and any change, modification or addition appropriately made within the spirit of the present invention will be evidently included within the scope of claims of this patent application.

The invention claimed is:

1. A mass analysis method using a multi-turn time-of-flight ion optical system in which ions originating from a sample is made to fly repeatedly along a loop orbit and then, at a predetermined point in time or later than that, divert from the loop orbit to be detected by a detector, which is characterized by comprising:

a) a no-passing mode execution step for obtaining a time-of-flight spectrum by performing a mass analysis of a target sample in a no-passing mode in which the ion is either prevented from completing one turn along the loop orbit or allowed to fly through the loop orbit a number of times within a range where any ion is assuredly prevented from lapping or passing another ion;

b) a peak information collection step for collecting information relating to a peak appearing on the time-of-flight spectrum obtained by an operation of the no-passing mode; and c) a timing determination step for predicting, based on the collected information relating to the peak, a number of turns and a time of flight corresponding to the peak to be observed when a mass analysis of the target sample is performed in a loop-turn mode in which the ion is made to fly through the loop orbit, and for determining a timing for beginning a diversion of the ion from the loop orbit so that at least a peak corresponding to an ion of interest can be separately identified on a time-of-flight spectrum based on an prediction.

2. The mass analysis method according to claim 1, which is characterized by further comprising:

d) a loop-turn mode execution step for performing the mass analysis of the target sample in the loop-turn mode at the timing for beginning the diversion of the ion determined in the timing determination step; and e) a mass identification step for identifying a mass of an ion corresponding to a peak appearing on a thereby obtained time-of-flight spectrum, based on an actual time of flight of the peak and the number of turns predicted in the timing determination step.

3. The mass analysis method according to claim 2, which is characterized in that the timing determination step includes defining, on a time-of-flight axis of the time-of-light spectrum based on the aforementioned prediction, a plurality of regions in which the mass and the time of flight can be uniquely determined, and determining the aforementioned timing under a condition that none of the plurality of regions should overlap each other, or even if any of these regions overlap another, no peak should exist within an overlapped range.

4. The mass analysis method according to claim 2, which is characterized in that the peak information collection step includes selecting a peak, under a predetermined condition, from the peaks appearing on the time-of-flight spectrum in the no-passing mode, and the timing determination step includes designating an ion corresponding to the selected peak as the aforementioned ion of interest.

5. The mass analysis method according to claim 1, which is characterized in that the timing determination step includes defining, on a time-of-flight axis of the time-of-flight spectrum based on the aforementioned prediction, a plurality of regions in which the mass and the time of flight can be uniquely determined, and determining the aforementioned timing under a condition that none of the plurality of regions should overlap each other, or even if any of these regions overlap another, no peak should exist within an overlapped range.

6. The mass analysis method according to claim 1, which is characterized in that the peak information collection step includes selecting a peak, under a predetermined condition, from the peaks appearing on the time-of-flight spectrum in the no-passing mode, and the timing determination step includes designating an ion corresponding to the selected peak as the aforementioned ion of interest.

7. A mass analysis system using a multi-turn time-of-flight ion optical system in which ions originating from a sample is made to fly repeatedly along a loop orbit and then, at a predetermined point in time or later than that, divert from the loop orbit to be detected by a detector, which is characterized by comprising:

a) a no-passing mode execution control means for obtaining a time-of-flight spectrum by performing a mass analysis of a target sample in a no-passing mode in which the ion is either prevented from completing one turn along the loop orbit or allowed to fly through the loop orbit a number of times within a range where any ion is assuredly prevented from lapping or passing another ion;

b) a peak information collection means for collecting information relating to a peak appearing on the time-of-flight spectrum obtained by an operation of the no-passing mode; and c) a timing determination means for predicting, based on the collected information relating to the peak, a number of turns and a time of flight corresponding to the peak to be observed when a mass analysis of the target sample is performed in a loop-turn mode in which the ion is made to fly through the loop orbit, and for determining a timing for beginning a diversion of the ion from the loop orbit so that at least a peak corresponding to an ion of interest can be separately identified on a time-of-flight spectrum based on the prediction.

8. The mass analysis system according to claim 7, which is characterized by further comprising:

d) a loop-turn mode execution control means for performing the mass analysis of the target sample in the loop-turn mode at the timing for beginning the diversion of the ion determined by the timing determination means; and e) a mass identification means for identifying a mass of an ion corresponding to a peak appearing on a thereby obtained time-of-flight spectrum, based on the actual time of flight of the peak and the number of turns predicted by the timing determination means.

9. The mass analysis system according to claim 8, which is characterized in that the timing determination means defines, on a time-of-flight axis of the time-of-flight spectrum based on the aforementioned prediction, a plurality of regions in which the mass and the time of flight can be uniquely determined, and determines the aforementioned timing under a condition that none of the plurality of regions should overlap each other, or even if any of these regions overlap another, no peak should exist within an overlapped range.

10. The mass analysis system according to claim 8, which is characterized in that the peak information collection means selects a peak, under a predetermined condition, from the peaks appearing on the time-of-flight spectrum in the no-passing mode, and the timing determination means designates an ion corresponding to the selected peak as the aforementioned ion of interest.

11. The mass analysis system according to claim 8, which is characterized in that the ion optical system includes an ejection switch for changing a traveling direction of an ion so as to divert the ion from the loop orbit.

12. The mass analysis system according to claim 7, which is characterized in that the timing determination means defines, on a time-of-flight axis of the time-of-flight spectrum based on the aforementioned prediction, a plurality of regions in which the mass and the time of flight can be uniquely determined, and determines the aforementioned timing under a condition that none of the plurality of regions should overlap each other, or even if any of these regions overlap another, no peak should exist within an overlapped range.

13. The mass analysis system according to claim 7, which is characterized in that the peak information collection means selects a peak, under a predetermined condition, from the peaks appearing on the time-of-flight spectrum in the no-passing mode, and the timing determination means designates an ion corresponding to the selected peak as the aforementioned ion of interest.

14. The mass analysis system according to claim 7, which is characterized in that the ion optical system includes an ejection switch for changing a traveling direction of an ion so as to divert the ion from the loop orbit.

* * * * *